United States Patent [19]

Miedaner et al.

[11] 4,433,523

[45] Feb. 28, 1984

[54] BLOCK OR BRICK FOR THE CONSTRUCTION OF A TWO-SHELL TILE STOVE

[76] Inventors: Horst Miedaner, Guetratweg 10; Herbert Spirk, Kühbergstr. 31, both of A-5020 Salzburg, Austria

[21] Appl. No.: 306,612

[22] PCT Filed: Dec. 30, 1980

[86] PCT No.: PCT/AT80/00037

§ 371 Date: Sep. 17, 1981

§ 102(e) Date: Sep. 17, 1981

[87] PCT Pub. No.: WO81/02192

PCT Pub. Date: Aug. 6, 1981

[51] Int. Cl.[3] ..... E04C 1/10

[52] U.S. Cl. ..... 52/592; 52/605; 126/144; 110/336

[58] Field of Search ..... 52/589–593, 52/286, 444, 605; 110/336, 338; 126/144, 151

[56] References Cited

U.S. PATENT DOCUMENTS

| | | | |
|---|---|---|---|
| 1,050,137 | 1/1913 | Horner | 52/444 |
| 1,202,387 | 10/1916 | Hitchcock | 110/338 |
| 1,492,685 | 5/1924 | Hale | 110/336 |

FOREIGN PATENT DOCUMENTS

| | | | |
|---|---|---|---|
| 109875 | 2/1928 | Austria | 52/444 |
| 314165 | 3/1974 | Austria . | |
| 102765 | 10/1965 | Denmark | 52/593 |
| 188253 | 4/1906 | Fed. Rep. of Germany . | |
| 361537 | 10/1922 | Fed. Rep. of Germany . | |
| 920986 | 12/1954 | Fed. Rep. of Germany . | |
| 2157478 | 5/1972 | Fed. Rep. of Germany | 52/593 |
| 107354 | 3/1925 | Switzerland | 52/605 |
| 248628 | 2/1948 | Switzerland . | |

*Primary Examiner*—James L. Ridgill, Jr.

*Attorney, Agent, or Firm*—Karl F. Ross; Herbert Dubno

[57] ABSTRACT

The block or brick is adapted to ensure an easy construction of a two-shell tile stove without requiring any particular skill in the art. A longitudinal center rib projects from two faces of the block adapted to contact adjacent blocks, longitudinal center grooves arranged on the two opposite faces correspond to said longitudinal rib. At least one first lateral groove whose depth and breadth corresponds to the depth and breadth of said longitudinal groove is arranged on a first side face, the marginal distances of said longitudinal groove and of said lateral groove being equal. A number of first lateral grooves whose center distance corresponds to the wall thickness of the block and second lateral grooves intersecting said first lateral grooves at a right angle are preferably provided on said first side face, said second lateral grooves being arranged and shaped like said first lateral grooves. The second side face is closed and planar, i.e. free from discontinuities.

7 Claims, 10 Drawing Figures

BLOCK OR BRICK FOR THE CONSTRUCTION OF A TWO-SHELL TILE STOVE

CROSS REFERENCE TO RELATED APPLICATIONS

This application is a national phase application corresponding to PCT/AT80/00004 filed Dec. 30, 1980 and based, in turn, upon an Austrian application No. AT/80/00037 filed Jan. 31, 1980 under the International Convention.

FIELD OF THE INVENTION

This invention relates to a block or brick for the construction of a two-shell tile stove having an internal shell of refractory blocks or bricks and an external shell of tiles.

BACKGROUND OF THE INVENTION

Tile stoves, which are generally made by stove fitters, consist of ceramic tiles with ribs arranged on their rear sides and running parallel to their edges. Said ribs are adapted to link the individual tiles to one another by means of connecting clamps or the like, and the joints between the tiles are closed by means of a refractory material. The internal structure, the flue gas vents, are also made by refractory blocks, which have to be processed to yield the required shape. The construction of a tile stove requires hard work, skill in the art as well as great technical skill. To facilitate assembly, efforts have been made to construct the tile stove with two shells. In this case, the internal shell and structure are made of refractory blocks, and then the outer surface is formed by tiles, either by individual tiles or by slabs consisting of tiles. This work, too, usually requires a person skilled in the art even though the work is substantially facilitated because of the external shell of tiles.

OBJECTS OF THE INVENTIION

It is, therefore, the object of this invention to provide blocks of the afore-mentioned kind for the construction of a two-shell tile stove by means of which tile stoves of any size can easily be constructed without requiring any particular skill in the art. It is a particular object of the invention to facilitate the assembly of the internal shell and structure, such as flue gas vents etc.

SUMMARY OF THE INVENTION

According to the invention this is achieved by providing a block whose length and height are derived from the side length of the visible tile face with a longitudinal center rib on two faces which are intended for contact with adjacent blocks, and by providing a corresponding longitudinal groove on the two opposite faces of the block, each, and at least one first lateral groove arranged on a first side face and being equal to the longitudinal groove, at least one marginal distance of the lateral groove corresponding to the marginal distance of the longitudinal groove, the second of the two side faces being closed and planar, i.e. free from discontinuities.

Blocks having grooves and ribs on their faces in contact with adjacent blocks and on their side faces have already been described in the AT-PS No. 314.165. The blocks described therein have, however, grooves and ribs on both side faces so that they are unsuitable for the construction of the internal shell of a tile stove. In tile stoves, the side faces of the blocks directed towards the tiles must be closed and planar in order to prevent the formation of air cushions between the adjacent tiles and the blocks, which cushions would impair the heat conduction.

In a first embodiment of the invention the side faces are provided with at least two first parallel lateral grooves, the center distance of said grooves corresponding to the wall thickness of the block.

A particularly large number of positions of the blocks in respect of one another will be obtained by providing the side face with at least one second lateral groove being to the longitudinal groove, said second lateral groove intersecting the first lateral groove or grooves at a right angle, the marginal distance of said second lateral groove corresponding to the marginal distance of the longitudinal groove. This embodiment, too, preferably provides that at least two second parallel lateral grooves are arranged on the side face, the center distance of said second lateral grooves corresponding to the wall thickness of the block.

The block or brick according to the invention comprises, as already mentioned, a closed planar side face which is directed towards the tiles. Hence, the internal shell has a planar external face on which the tiles fit snuggly, and the formation of air cushions and air channels is eliminated. In spite of the fact that grooves are only provided on three sides, construction of the internal structure is facilitated, the longitudinal ribs of horizontally arranged blocks being adapted to engage the latral grooves of the blocks of the internal shell. A thin layer of adhesive mortar is preferably employed for connecting the blocks. The blocks can be prefabricated to form a construction kit and can easily be assembled without any skill by means of enclosed instructions or plans. The correct cross-sections of flue gas vents need not be determined, no particular attention is required, when bricking up the blocks etc., as the blocks have been put together correctly, when one rib provided on the block face engages one longitudinal groove or lateral groove.

BRIEF DESCRIPTION OF THE DRAWING

The invention is described in greater detail with reference to the accompanying drawing in which.

SPECIFIC DESCRIPTION

Figure 10:
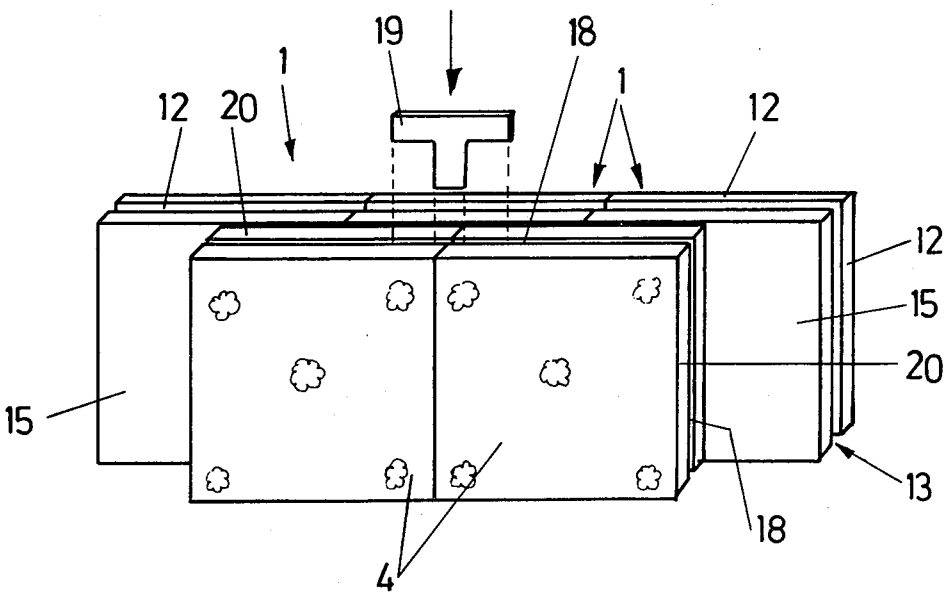
FIG. 10 shows a sectional view of the two shells of the tile stove.

The blocks 1 according to the invention preferably have square side faces 14, 15, one side face 15 being closed and planar. When constructing the internal shell of a tile stove, the blocks 1 are staggered in such a manner that the closed planar side faces 15 form the external side of the internal shell so that the tiles 4 fit snuggly on the blocks 1 without forming air cushions or air channels. The tiles 4 obviously have planar closed rear faces without ribs. For linking the tiles 4 to one another (FIG. 10), their faces 20 being in contact with adjacent tiles are provided with circumferential grooves 18. T-shaped connecting members 19 are inserted into the the grooves of the tiles 4, the center leg of the T-shaped connecting member 19 connecting two adjacent tiles 4 and the cross bar of the connecting member 19 said two adjacent tiles with a tile 4 of the following row.

Two faces 10 of the block 1 for contact with adjacent blocks are provided with longitudinal center ribs 12, and the two opposite faces 11 are provided with longitudinal grooves 13 corresponding to the longitudinal ribs 12. As illustrated in FIGS. 1 through 6 as well as 9 and 10, the longitudinal ribs 12 and the longitudinal grooves 13 can be arranged on adjacent faces of the block or, according to FIGS. 7 and 8, on opposite faces of the block.

The construction of the tile stove is substantially facilitated by first and second lateral grooves 16, 17, which are provided on the other side face 14 of the block 1 directed towards the inside, when being bricked up.

Figure 1:
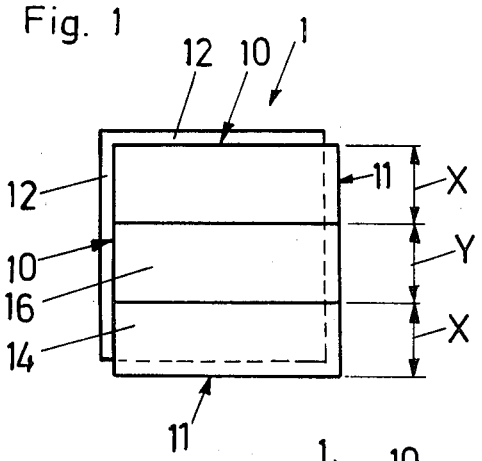
FIGS. 1 through 4 are top views and side views of two embodiments of a block according to the invention.
Figure 2:
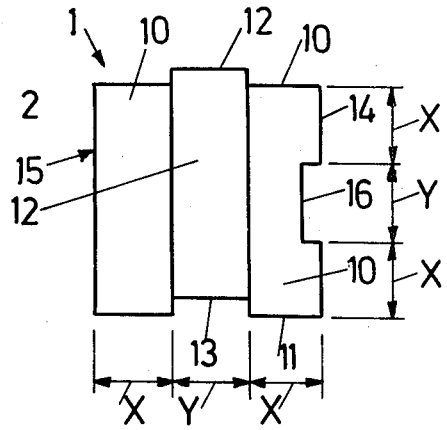

FIGS. 1 and 2 show a first embodiment with a first lateral groove 16, the marginal distances x of the lateral grooves 16 corresponding to the marginal distances of the longitudinal grooves 13 in the faces 11. The first lateral groove 16 has a breadth y, which is equal to the breadth of the longitudinal groove 13 and, hence, of the longitudinal rib 12, so that the block 1 illustrated in FIGS. 1 and 2 forms substantially a cube. When constructing a corner, the block 1 is turned from the illustrated position by 90° so that the first lateral groove 16 runs vertically. The longitudinal rib 12 of the face 10 can, hence, be inserted into the first lateral groove 16.

Figure 3:
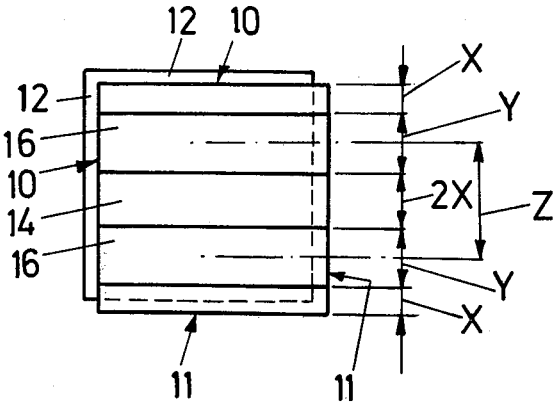
Figure 4:
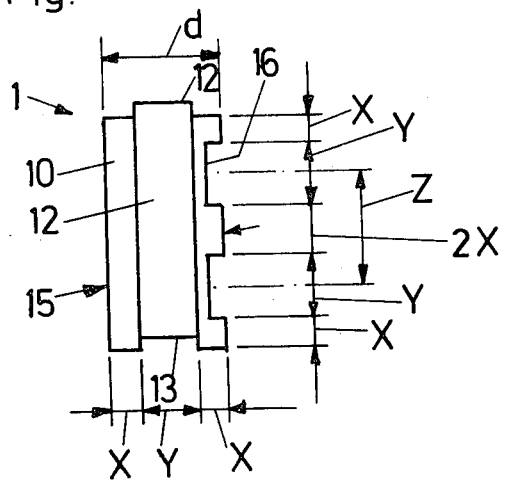

The embodiment illustrated in FIG. 3 shows a block 1 having two first lateral grooves 16 in the side faces 14, said lateral grooves 16 having a marginal distance x corresponding to the marginal distance of the longitudinal groove 13 and being spaced from each other by the distance 2 x. The breadth y of the first lateral groove 16 corresponds again to the breadth of the longitudinal groove 13. As a result, the center distance z of the two lateral grooves 16 corresponds to the wall thickness d, which corresponds to half the height of the block 1.

Figure 5:
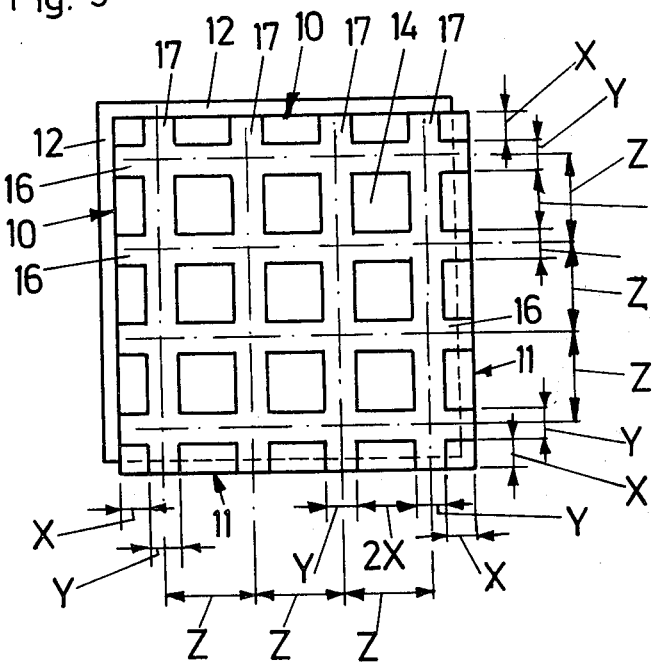
FIGS. 5 and 6 are similar views of a third embodiment.
Figure 6:
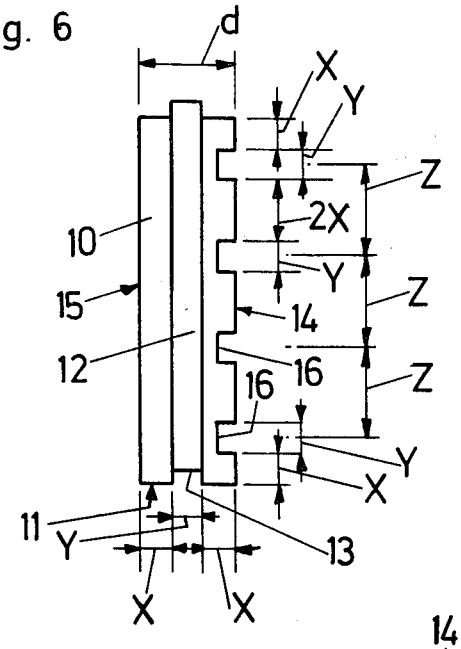

FIGS. 5 and 6 show a preferred embodiment. Four first lateral grooves 16 are provided on the side faces 14, said grooves 16 having the breadth y being equal to the breadth of the longitudinal groove 13, the center distance z of two first lateral grooves 16, each, being equal to the wall thickness d and the marginal distance x being equal to the marginal distance of the longitudinal groove 13. Moreover, four second lateral grooves 17 are provided, which intersecting the first lateral grooves 16 at a right angle and for which the same relations are true. Elevations remain between the lateral grooves 16, 17, the surfaces of said elevations having the size x multiplied by x in the corner region, the size x multipled by 2 x in the residual marginal portion and the size 2 x multiplied by 2 x in the center portion.

Figure 9:
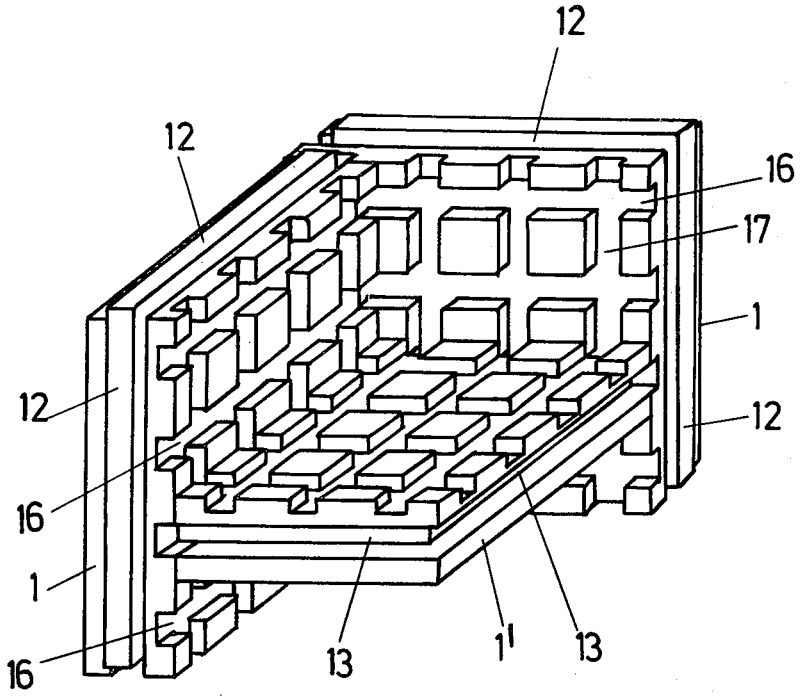
FIG. 9 shows a part of a corner bricked up by means of blocks according to the invention.

Because of its great number of lateral grooves, this block can be used for all intermediate plates, partition walls for flue gas vents etc. required in the internal structure of the tile stove, as, according to the embodiment illustrated in FIG. 9, any required arrangement can be formed in a simple manner.

Figure 7:
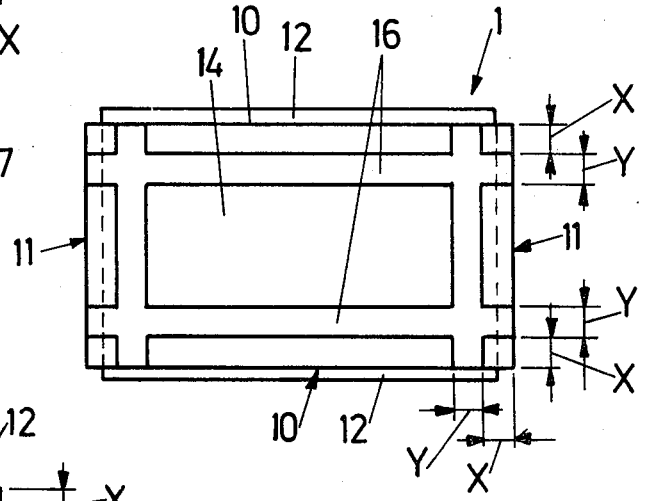
FIGS. 7 and 8 are views of a further embodiment.
Figure 8:
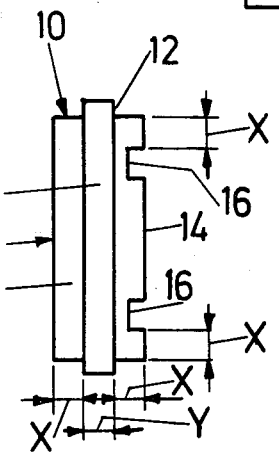

The brick illustrated in FIGS. 7 and 8 shows a further variant with rectangular side faces 14, 15. Two first and two second lateral side grooves 16, 17, each, are provided on the side faces 14, said lateral grooves having the marginal distances x corresponding to the marginal distances of the longitudinal grooves 13 and longitudinal ribs 12. This embodiment shows the possibility of providing the longitudinal ribs 12 and the longitudinal grooves 13 on two opposite faces 3. This block can obviously also be provided with further lateral grooves.

By means of the blocks or bricks according to this invention, the dimensions of the individual blocks required for two-shell tile stoves can be pre-calculated and bought preferably together with the tiles 4 as a construction kit. The internal shell and the internal structure can be built according to instructions without requiring any particular skill in the art as the length of the individual blocks is clearly defined by the grooves and ribs, and, moreover, in case of several possibilities said length can be easily pre-marked.

What is claimed is:

1. A refractory block for the construction of an internal shell structure of a two-shell tile stove having an external shell of tiles, said block comprising a generally rectangular parallelopipedly body of refractory material formed with a longitudinal center rib on each of two faces adapted to contact adjacent blocks, a corresponding longitudinal groove on each of the opposite faces of said block, at least one first lateral groove arranged on a first side face, at least one second lateral groove intersecting each first lateral groove at a right angle, each of said lateral grooves being identical to said longitudinal groove, and the marginal distance of the respective first and second lateral grooves corresponding to the marginal distance of said longitudinal groove, and a second side face which is closed, planar and free from discontinuities.

2. A block as defined in claim 1 wherein the widths of said longitudinal rib and said longitudinal groove in the respective faces in contact with adjacent blocks correspond to half the wall thickness of the block.

3. A block as defined in claim 1 wherein said first side face is provided with at least two first and two second lateral grooves, said first and second grooves being mutually parallel, the center distance of each pair of parallel grooves corresponding to the wall thickness of said block.

4. A block as defined in claim 3 wherein the length and the height of said first side face each correspond to the same integral multiple of the wall thickness, the number of mutually parallel side grooves being respectively equal to said multiple.

5. A two-shell tile stove comprising a plurality of angularly adjoining walls each formed of a multiplicity of rows of mutually interfitting refractory generally rectangular parallelopipedal blocks with the blocks contacting adjacent blocks of the row, each block comprising a body formed with a longitudinal center rib on each of two faces in contact with adjacent blocks, a corresponding longitudinal groove on each of the opposite faces of said block, at least one first lateral groove arranged on a first side face, at least one second lateral groove intersecting each first lateral groove at a right angle, each of said lateral grooves being identical to said longitudinal groove, and the marginal distance of the respective first and second lateral grooves corresponding to the marginal distance of said longitudinal groove, and a second side face which is closed, planar and free from discontinuities, the second side faces of said blocks being turned outwardly; and an external shell of tiles bonded to said second side faces.

6. The stove defined in claim 5 wherein said first side face of each block is provided with at least two first and two second lateral grooves, said first and second grooves being mutually parallel, the center distance of each pair of parallel grooves corresponding to the wall thickness of said block.

7. The store defined in claim 6 wherein the length and the height of said first side face of each block each correspond to the same integral multiple of the wall thickness, the number of mutually parallel side grooves being respectively equal to said multiple.

* * * * *